US011721925B2

(12) United States Patent
Furuta et al.

(10) Patent No.: US 11,721,925 B2
(45) Date of Patent: Aug. 8, 2023

(54) TERMINAL-EQUIPPED ELECTRIC WIRE, CONNECTOR AND MANUFACTURING METHOD OF CONNECTOR

(71) Applicant: YAZAKI CORPORATION, Tokyo (JP)

(72) Inventors: Taku Furuta, Makinohara (JP); Ryo Hamada, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 29 days.

(21) Appl. No.: 17/558,591

(22) Filed: Dec. 22, 2021

(65) Prior Publication Data

US 2022/0200187 A1 Jun. 23, 2022

(30) Foreign Application Priority Data

Dec. 23, 2020 (JP) ..... 2020-214014

(51) Int. Cl.
*H01R 13/436* (2006.01)
*H01R 4/02* (2006.01)
*H01R 4/62* (2006.01)
*H01R 43/20* (2006.01)

(52) U.S. Cl.
CPC ..... *H01R 13/4361* (2013.01); *H01R 4/023* (2013.01); *H01R 4/625* (2013.01); *H01R 43/20* (2013.01)

(58) Field of Classification Search
CPC .... H01R 43/20; H01R 13/4361; H01R 4/625; H01R 4/182; H01R 4/183; H01R 4/187; H01R 4/023
See application file for complete search history.

(56) References Cited

U.S. PATENT DOCUMENTS 3,798,010 A * 3/1974 Sharp, Jr. ..... B32B 15/012 428/614
10,840,634 B2 * 11/2020 Kojima ..... H02G 3/04
10,903,599 B2 * 1/2021 Lienert ..... H02G 15/046
2011/0114363 A1 5/2011 Schloms et al.
2013/0225014 A1 * 8/2013 Sato ..... H01R 4/185 439/736

(Continued)

FOREIGN PATENT DOCUMENTS

EP 3324487 B1 * 12/2020 ..... B23K 20/10
JP 2010-257843 A 11/2010

(Continued)

*Primary Examiner* — Marcus E Harcum
(74) *Attorney, Agent, or Firm* — Kenealy Vaidya LLP

(57) ABSTRACT

A terminal-equipped electric wire, a connector including the terminal-equipped electric wire and a manufacturing method of the connector are provided. The terminal-equipped electric wire includes an electric wire including a conductor core wire formed of a conductor material and a terminal formed of a composite metal material in which a plurality of types of metal materials are clad-bonded with each other. The terminal includes a first connection portion and a second connection portion, each of which is formed of a metal material of respective one of the plurality of types of metal materials. The conductor core wire is electrically connected to one of the first and second connection portions, the one corresponding to the conductor material forming the conductor core wire.

7 Claims, 7 Drawing Sheets

(56) References Cited

U.S. PATENT DOCUMENTS

| | | | | |
|---|---|---|---|---|
| 2014/0011411 | A1* | 1/2014 | Matsushita | H01R 4/62 439/877 |
| 2014/0246231 | A1* | 9/2014 | Adachi | B60R 16/0215 174/72 A |
| 2016/0028177 | A1 | 1/2016 | Nomura et al. | |
| 2016/0365648 | A1* | 12/2016 | Aoki | H01R 4/185 |
| 2018/0158569 | A1* | 6/2018 | Yoshida | H01R 4/62 |
| 2019/0296499 | A1* | 9/2019 | Mori | H01R 13/6581 |
| 2020/0083616 | A1* | 3/2020 | Kameda | H01B 13/00 |
| 2020/0194937 | A1* | 6/2020 | Maesoba | H01R 4/187 |
| 2021/0203086 | A1* | 7/2021 | Yamashita | H01B 7/2806 |
| 2022/0368040 | A1* | 11/2022 | Wi | H01R 4/5083 |
| 2022/0376419 | A1* | 11/2022 | Wi | H01R 13/187 |

FOREIGN PATENT DOCUMENTS

| | | | |
|---|---|---|---|
| JP | 2020-37745 | A | 3/2020 |
| WO | 2013/092193 | A1 | 6/2013 |

* cited by examiner

TERMINAL-EQUIPPED ELECTRIC WIRE, CONNECTOR AND MANUFACTURING METHOD OF CONNECTOR

CROSS-REFERENCE TO RELATED APPLICATION

The present application claims priority to Japanese Patent Application No. 2020-214014 filed on Dec. 23, 2020, the entire content of which is incorporated herein by reference.

TECHNICAL FIELD

The presently disclosed subject matter relates to a terminal-equipped electric wire including an electric wire and a terminal formed of a composite metal material obtained by cladding a plurality of types of metal materials. Further, the presently disclosed subject matter relates to a connector using the terminal-equipped electric wire, and a manufacturing method of the connector.

BACKGROUND

For example, in vehicles such as an automobile, for purposes such as power supply to various electric components, communication between the electric components and a control device, and ground connection of the electric components and the control device, various terminal-equipped electric wires in related art are used (for example, refer to JP2020-037745A).

In general, a type of a metal material forming a terminal and a type of a metal material forming an electric wire (particularly, a conductor core wire) are selected from the viewpoint of conductivity and durability, a weight of the terminal-equipped electric wire, and the like according to a purpose of use of the terminal-equipped electric wire. For example, the terminal and the electric wire are appropriately selected according to the purpose of use, from a copper terminal made of copper or a copper alloy, an aluminum terminal made of aluminum or an aluminum alloy, a copper electric wire whose conductor core wire is made of copper or a copper alloy, an aluminum electric wire whose conductor core wire is made of aluminum or an aluminum alloy, and the like. Here, since it is generally difficult to stably electrically bond different types of metals to each other, the electric wire and the terminal are usually selected so that a conductor material forming the conductor core wire and a metal material forming the terminal are the same. However, it may not be very efficient to prepare and manage electric wires and terminals of various materials in advance in preparation for such selection. From the viewpoint of improving production efficiency of manufacturing of the terminal-equipped electric wire, it is desirable to achieve commonization of the electric wire and the terminal (for example, even when the type of the conductor material forming the conductor core wire varies, a common terminal should be used as much as possible).

SUMMARY

Illustrative aspects of the presently disclosed subject matter provide a terminal-equipped electric wire that is excellent in production efficiency, a connector using the terminal-equipped electric wire, and a manufacturing method of the connector.

According to an illustrative aspect of the presently disclosed subject matter, a terminal-equipped electric wire includes an electric wire including a conductor core wire formed of a conductor material and a terminal formed of a composite metal material in which a plurality of types of metal materials are clad-bonded with each other. The terminal includes a first connection portion and a second connection portion, each of which is formed of a metal material of respective one of the plurality of types of metal materials. The conductor core wire is electrically connected to one of the first and second connection portions, the one corresponding to the conductor material forming the conductor core wire. According to another illustrative aspect of the presently disclosed subject matter, a connector includes the terminal-equipped electric wire and a housing configured to accommodate the terminal-equipped electric wire. According to yet another illustrative aspect of the presently disclosed subject matter, a manufacturing method for manufacturing the connector including the terminal-equipped electric wire and a housing configured to accommodate the terminal-equipped electric wire includes holding the terminal in the housing such that at least a part of each of the first and second connection portions is exposed, selecting one connection portion out of the first and second connection portions which corresponds to the conductor material forming the conductor core wire of the electric wire to be used and electrically connecting the conductor core wire of the electric wire to be used to the one connection portion.

Other aspects and advantages of the invention will be apparent from the following description, the drawings and the claims.

BRIEF DESCRIPTION OF DRAWINGS

FIGS. 2A and 2B are perspective views showing the terminal-equipped electric wire according to the embodiment of the presently disclosed subject matter, in which FIG. 2A shows the terminal-equipped electric wire in which the copper electric wire shown in FIG. 1 is joined to a copper connection portion of the terminal shown in FIG. 1, and FIG. 2B shows the terminal-equipped electric wire in which the aluminum electric wire shown in FIG. 1 is joined to an aluminum connection portion of the terminal shown in FIG. 1;

FIG. 6A is a perspective view thereof, and FIG. 6B is a side view thereof.

DESCRIPTION OF EMBODIMENTS

Hereinafter, first, a terminal-equipped electric wire 2 according to an embodiment of the presently disclosed subject matter will be described with reference to the drawings. As shown in FIGS. 1 to 3B, the terminal-equipped electric wire 2 is configured by joining a copper electric wire 10A or an aluminum electric wire 10B to a terminal 20. The copper electric wire 10A and the aluminum electric wire 10B are assumed to be used in a wire harness or the like of an automobile.

Hereinafter, as shown in FIGS. 1 to 7, a "front-rear direction", an "upper-lower direction", a "width direction", "front", "rear", "upper", and "lower" (or "down") are defined for convenience of description. The front-rear direction, the upper-lower direction, and the width direction are orthogonal to each other. The front-rear direction coincides with an extending direction of the terminal-equipped electric wire 2. Hereinafter, each member forming the terminal-equipped electric wire 2 will be sequentially described.

Figure 1:
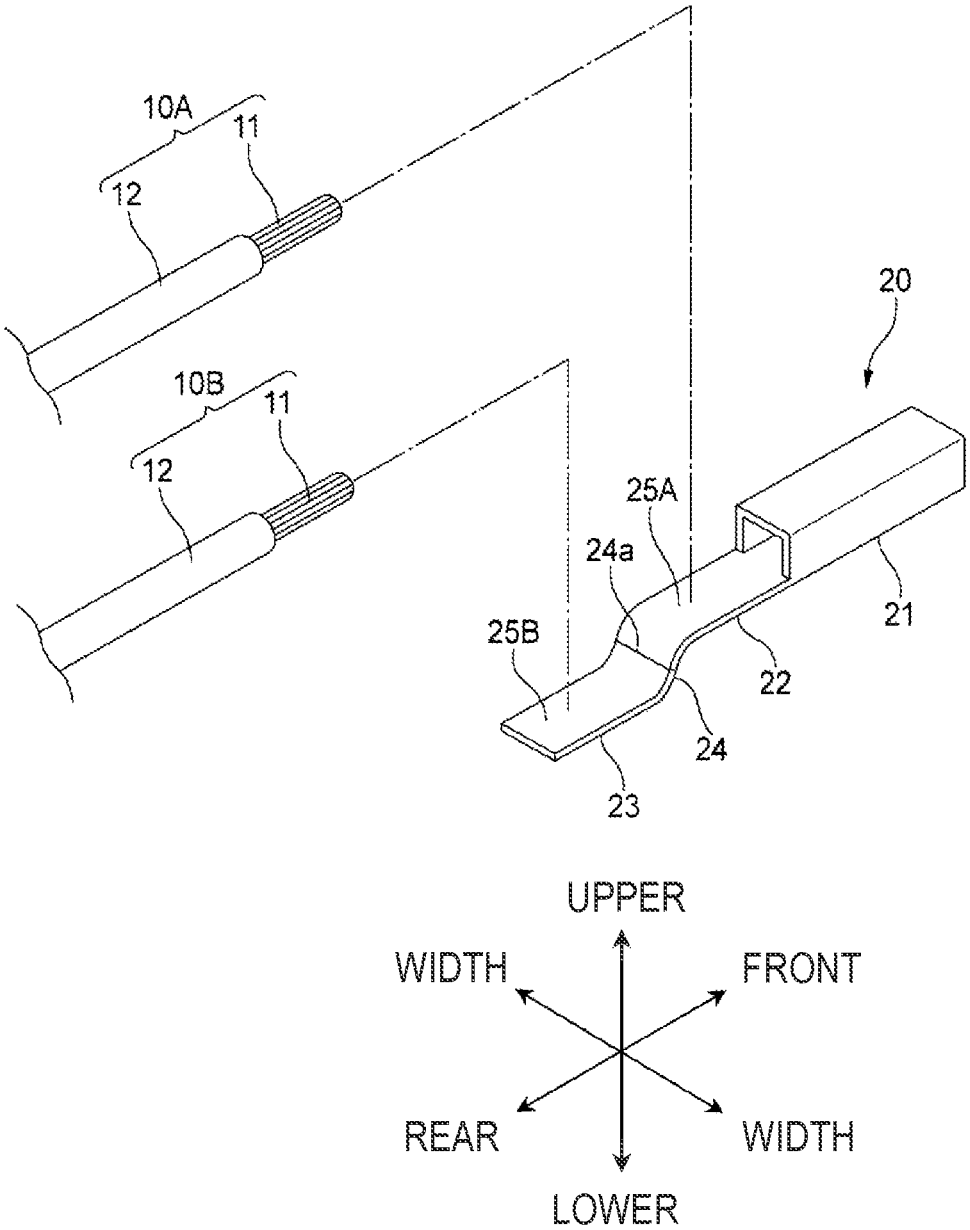
FIG. 1 is a perspective view showing a state where a terminal, a copper electric wire, and an aluminum electric wire that form a terminal-equipped electric wire according to an embodiment of the presently disclosed subject matter are disposed separately from each other.

First, the copper electric wire 10A and the aluminum electric wire 10B will be described. As shown in FIG. 1, the copper electric wire 10A includes a conductor core wire 11 that is made of copper or a copper alloy, and an insulating coating 12 that covers the conductor core wire 11. The conductor core wire 11 may be a single wire or an electric wire bundle in which a plurality of thin conductor wire cores are gathered. Similarly, the aluminum electric wire 10B includes the conductor core wire 11 that is made of aluminum or an aluminum alloy, and an insulating coating 12 that covers the conductor core wire 11. The conductor core wire 11 may be a single wire or an electric wire bundle in which a plurality of thin conductor wire cores are gathered.

Next, the terminal 20 will be described. As shown in FIGS. 1 and 3B, the terminal 20 extends in the front-rear direction. Specifically, the terminal 20 integrally includes a contact portion 21, a first connection portion 22, a second connection portion 23 and a step portion 24. The contact portion 21 has a rectangular tubular shape and extends in the front-rear direction. The first connection portion 22 has a rectangular flat plate shape and extends from a rear end portion of a bottom wall (lower wall) of the contact portion 21 rearward in the front-rear direction. The second connection portion 23 has a rectangular flat plate shape, extends in the front-rear direction and is positioned at a rear and lower side with respect to the first connection portion 22. The step portion 24 connects a rear end portion of the first connection portion 22 and a front end portion of the second connection portion 23 to each other such that the rear end portion of the first connection portion 22 and the front end portion of the second connection portion 23 are offset from each other along the upper-lower direction. The contact portion 21 is a portion to which a mating terminal (male terminal, not shown) is to be inserted and connected at a front side of the contact portion 21.

The contact portion 21, the first connection portion 22, and a part of the step portion 24 above a boundary position 24*a* (see FIGS. 1 and 3B) are integrally formed of copper or a copper alloy (hereinafter referred to as a "copper material portion"). The second connection portion 23 and another part of the step portion 24 below the boundary position 24*a* are integrally formed of aluminum or an aluminum alloy (hereinafter, referred to as an "aluminum material portion").

The copper material portion and the aluminum material portion are integrally connected by cladding such that a part of each of the copper material portion and the aluminum material portion forming the boundary position 24*a* are arranged side by side with each other along the front-rear direction. That is, the terminal 20 is formed as a so-called "parallel clad material".

As described above, cladding is a method in which bonding surfaces of the metal materials are brought into contact with each other in a pressed manner and subjected to a pressure treatment and a heat treatment to promote mutual diffusion of metal atoms forming both of the metal materials, thereby firmly diffusion-bonding both of the bonding surfaces to each other. Unlike techniques such as plating, generally no fragile intermetallic compound is generated between the bonding surfaces bonded by cladding. In this respect, cladding is excellent in bonding strength as compared with techniques such as plating, and separation between bonding surfaces or the like is less likely to occur.

The terminal 20 may be formed by performing cladding of the copper material portion and the aluminum material portion and then performing bending, pressing, and the like, or may be formed by performing cladding after performing bending, pressing, and the like.

In the terminal 20, an upper surface of the first connection portion 22 (that is, an upper surface of the copper material portion) forms a copper connection portion 25A (a first connection portion), and an upper surface of the second connection portion 23 (that is, an upper surface of the aluminum material portion) forms an aluminum connection portion 25B (a second connection portion). The aluminum connection portion 25B is disposed at a position that is located on a rear side and offset downward relative to the copper connection portion 25A. The members forming the terminal-equipped electric wire 2 have been described above.

Hereinafter, for convenience of description, when it is not necessary to distinguish the electric wire 10A and the electric wire 10B from each other, each of the electric wire 10A and the electric wire 10B may be referred to as the "electric wire 10", and when it is not necessary to distinguish the copper connection portion 25A and the aluminum connection portion 25B from each other, each of the copper connection portion 25A and the aluminum connection portion 25B may be referred to as the "connection portion 25".

Figure 2A:
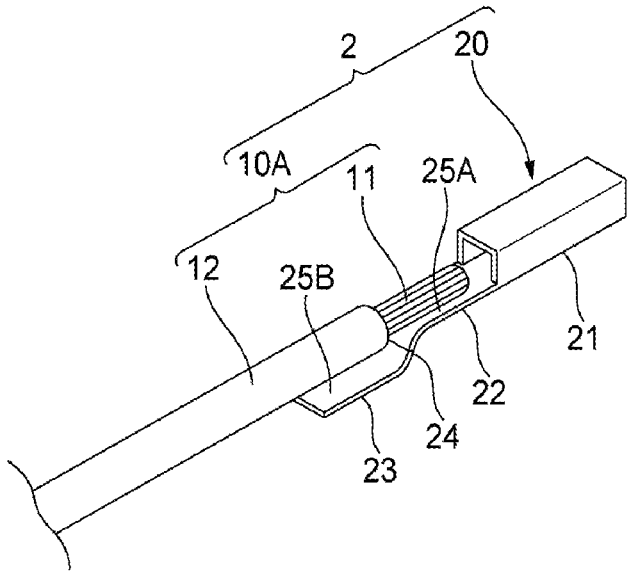
Figure 2B:
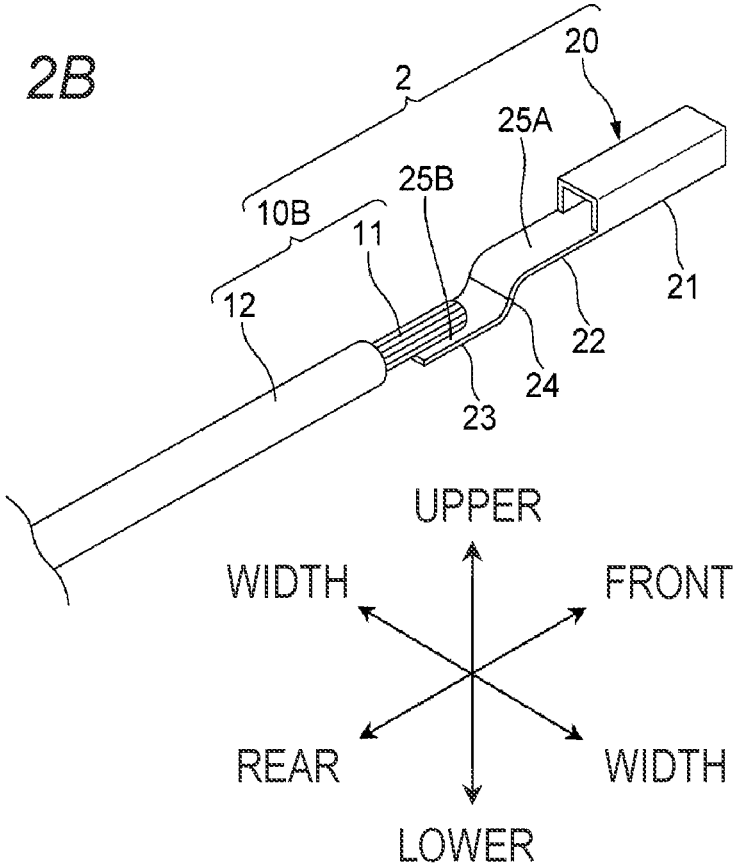
Figure 3A:
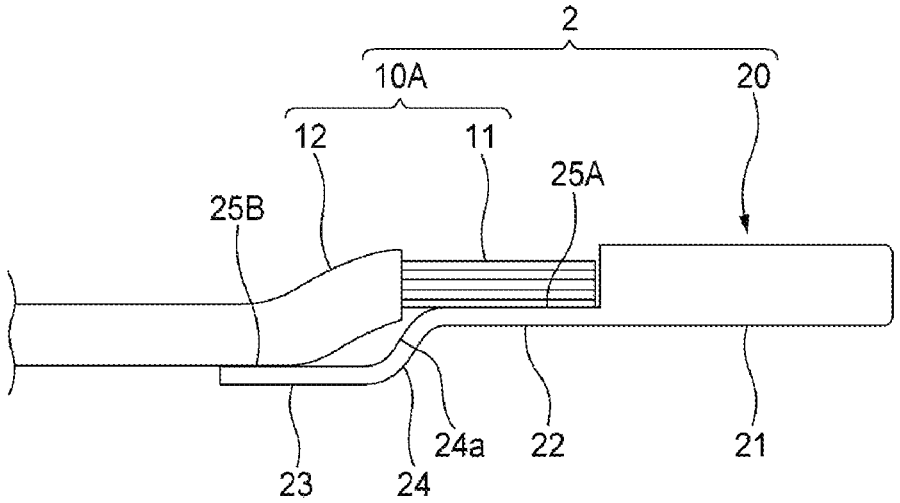
FIG. 3A is a side view of the terminal-equipped electric wire shown in FIG. 2A.
Figure 3B:
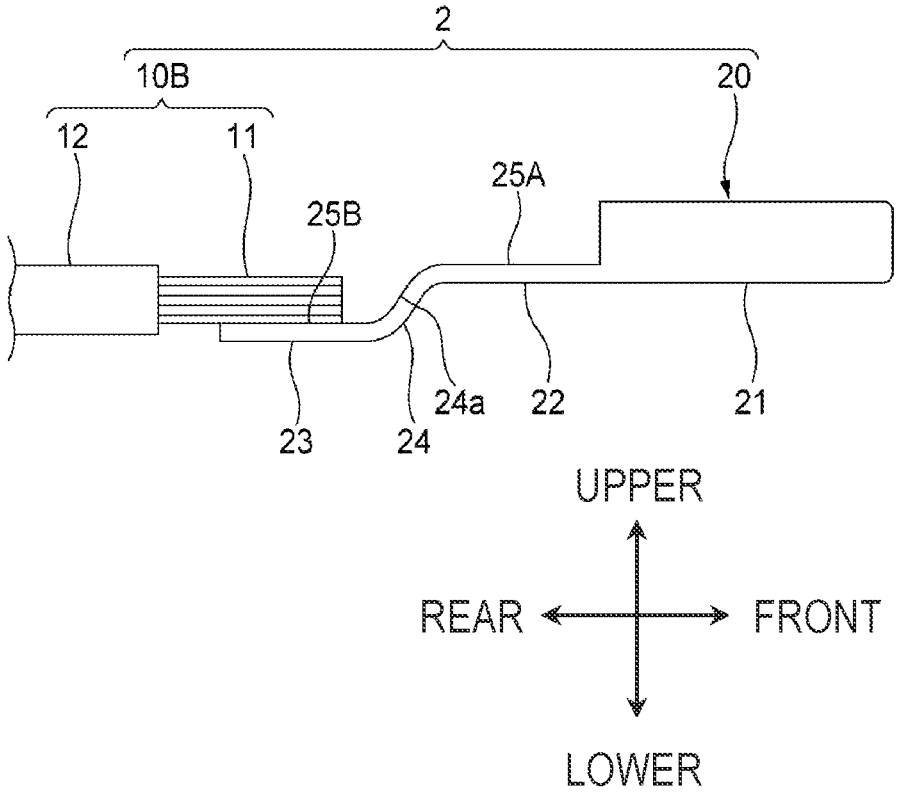
FIG. 3B is a side view of the terminal-equipped electric wire shown in FIG. 2B.

In the terminal-equipped electric wire 2, when the copper electric wire 10A is used, as shown in FIGS. 2A and 3A, the conductor core wire 11 (made of copper or a copper alloy) of the copper electric wire 10A is to be joined to the copper connection portion 25A such that the copper electric wire 10A extends rearward from the copper connection portion 25A. On the other hand, when the aluminum electric wire 10B is used, as shown in FIGS. 2B and 3B, the conductor core wire 11 (made of aluminum or an aluminum alloy) of the aluminum electric wire 10B is to be joined to the aluminum connection portion 25B such that the aluminum electric wire 10B extends rearward from the aluminum connection portion 25B. A joining method thereof is not particularly limited, and for example, welding using a laser, pressure joining, ultrasonic joining, or the like can be used. Further, in a case where a laser is used, if laser irradiation is performed on a predetermined joint portion by using a galvano scanner or the like, it is possible to automate manufacturing of the terminal-equipped electric wire 2 (that is, to manufacture by an automatic machine rather than manual work by an operator).

As described above, in either one of the cases where the copper electric wire 10A is used and the case where the aluminum electric wire 10B is used, regarding the joining of the terminal 20 and the conductor core wire 11, the conductor material of the terminal 20 and the metal material of the conductor core wire 11 are the same, or even if the conductor material of the terminal 20 and the metal material of the conductor core wire 11 are not completely the same, the natural potential difference therebetween is small to such an extent that there is no concern about quality deterioration caused by galvanic corrosion, and therefore, it is possible to establish stable electric connection over a long period of time. In addition, the terminal-equipped electric wire 2 can be manufactured by using the common terminal 20 for both the copper electric wire 10A and the aluminum electric wire 10B that are generally used in a wire harness or the like of an automobile.

Further, as can be understood from FIG. 3A, when the copper electric wire 10A is used, the copper connection portion 25A and the aluminum connection portion 25B are disposed at positions offset from each other so as to isolate the conductor core wire 11 to be joined to the copper connection portion 25A (made of copper or a copper alloy) from the aluminum connection portion 25B. Similarly, as can be understood from FIG. 3B, when the aluminum electric wire 10B is used, the copper connection portion 25A and the aluminum connection portion 25B are disposed at positions offset from each other so as to isolate the conductor core wire 11 to be joined to the aluminum connection portion 25B (made of aluminum or an aluminum alloy) from the copper connection portion 25A. Accordingly, even when the terminal-equipped electric wire 2 is exposed to water or the like, occurrence of galvanic corrosion between the conductor core wire 11 and the connection portion 25 that is not joined to the conductor core wire 11 among the copper connection portion 25A and the aluminum connection portion 25B can be prevented. It should be noted that a direction of the offset is not particularly limited, and in addition to the offset in the upper-lower direction as shown in the drawings, offset in the width direction or an oblique direction may also be adopted.

Next, a connector 1 according to an embodiment of the presently disclosed subject matter will be described with reference to the drawings. As shown in FIGS. 4A to 5B, the connector 1 includes a plurality of terminal-equipped electric wires 2 and a housing 30 that accommodates the plurality of terminal-equipped electric wires 2.

Figure 5A:
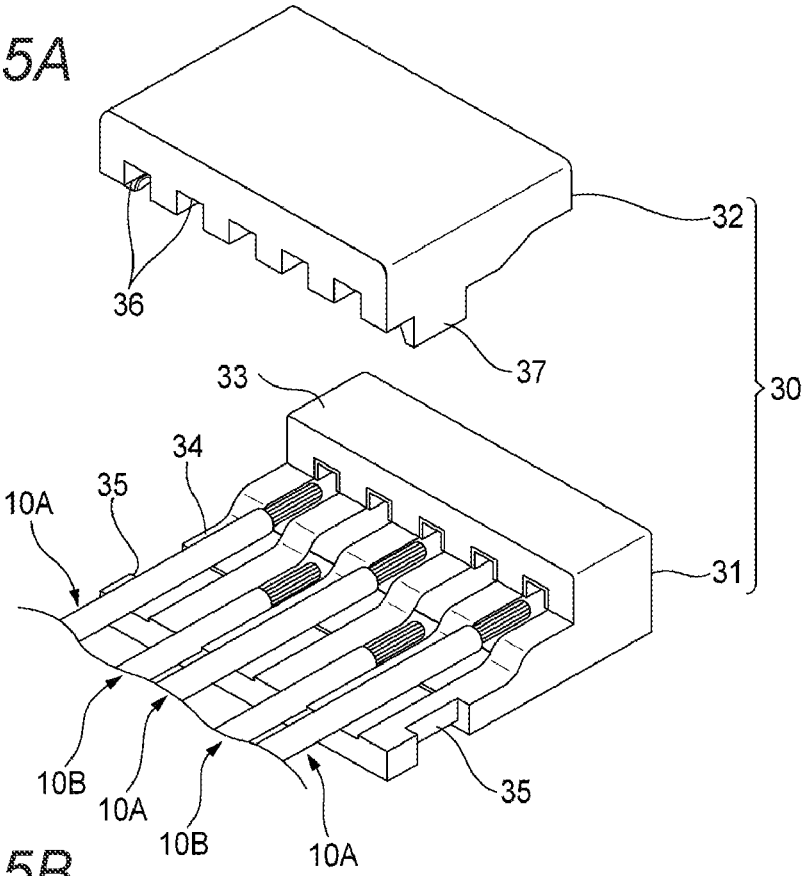
FIG. 5A is a third view showing the manufacturing procedure of the connector according to the embodiment of the presently disclosed subject matter.
Figure 5B:
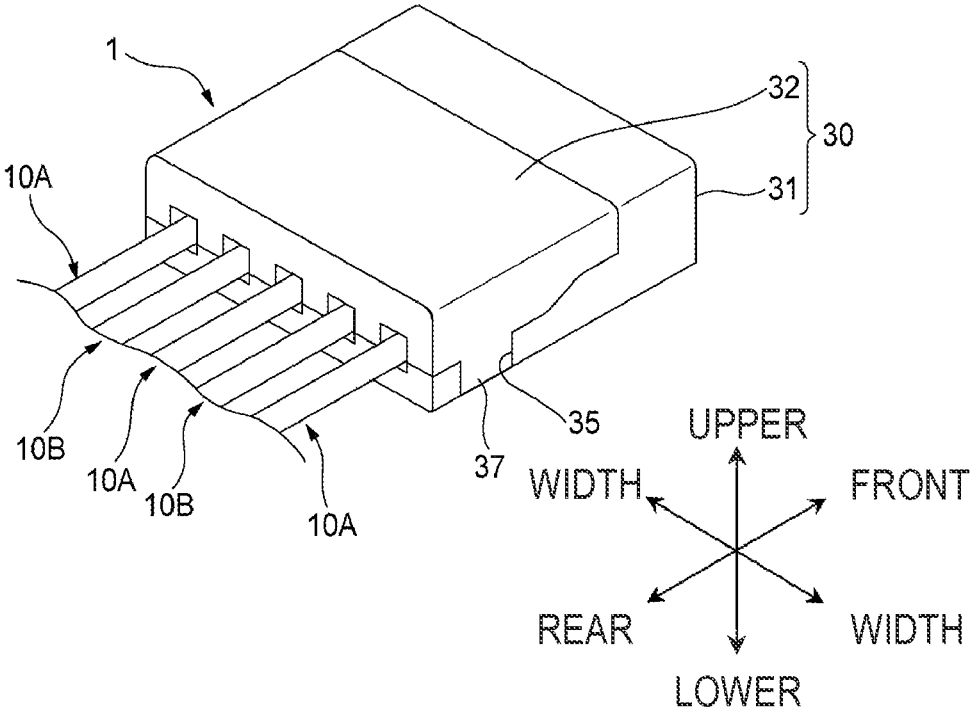
FIG. 5B is a fourth view showing the manufacturing procedure.

As shown in FIGS. 5A and 5B, the housing 30 includes a resin-made lower housing 31 and a resin-made upper housing 32 that can be attached to each other along the upper-lower direction. The lower housing 31 is mainly configured to hold the plurality of terminals 20, and the upper housing 32 is mainly configured to restrain displacement of the electric wires 10 extending from the terminals 20 relative to the terminals 20 by being attached to the lower housing 31.

Figure 4A:
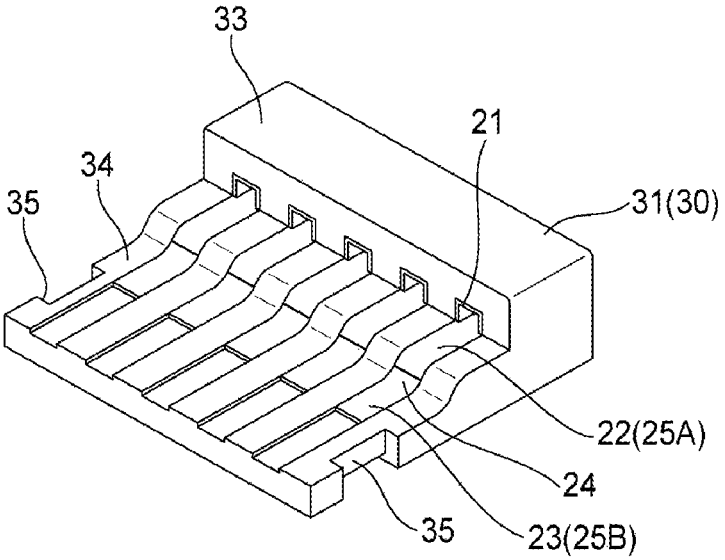
FIG. 4A is a first view for explaining a manufacturing procedure of a connector according to the embodiment of the presently disclosed subject matter.

As shown in FIG. 4A, the lower housing 31 has a substantially rectangular parallelepiped shape extending in the front-rear direction and the width direction. In the lower housing 31, the plurality of terminals 20 extending in the front-rear direction are integrated in the lower housing 31 by insert molding and arranged at intervals with each other in a row along the width direction. As a result, an entirety of side surfaces of the contact portion 21 of each terminal 20 is embedded in a contact portion holding portion 33 (extending in the width direction) that forms a front end portion of the lower housing 31. The first connection portion 22, the second connection portion 23, and the step portion 24 of each terminal 20 are embedded, in such a manner that upper surfaces thereof are exposed, in a connection portion holding portion 34 that forms a part of the lower housing 31 behind the contact portion holding portion 33 of the lower housing 31. As a result, the copper connection portion 25A and the aluminum connection portion 25B of each terminal 20 are exposed. A pair of engaging recesses 35 are formed on side surfaces of the connection portion holding portion 34 in the width direction.

As shown in FIG. 5A, the upper housing 32 has a substantially rectangular flat plate shape extending in the front-rear direction and the width direction. A lower surface of the upper housing 32 has a shape that can be attached to the connection portion holding portion 34 of the lower housing 31 from above. A plurality of electric wire holding portions 36 that are recessed upward and extend in the front-rear direction are formed on the lower surface of the upper housing 32 and arranged at intervals with each other in a row along the width direction, each of the plurality of electric wire holding portions 36 corresponding to each of the plurality of terminals 20 integrated with the lower housing 31. A pair of engaging protrusions 37 are formed on side surfaces of the upper housing 32 in the width direction so as to correspond to the pair of engaging recesses 35 of the lower housing 31.

Figure 4B:
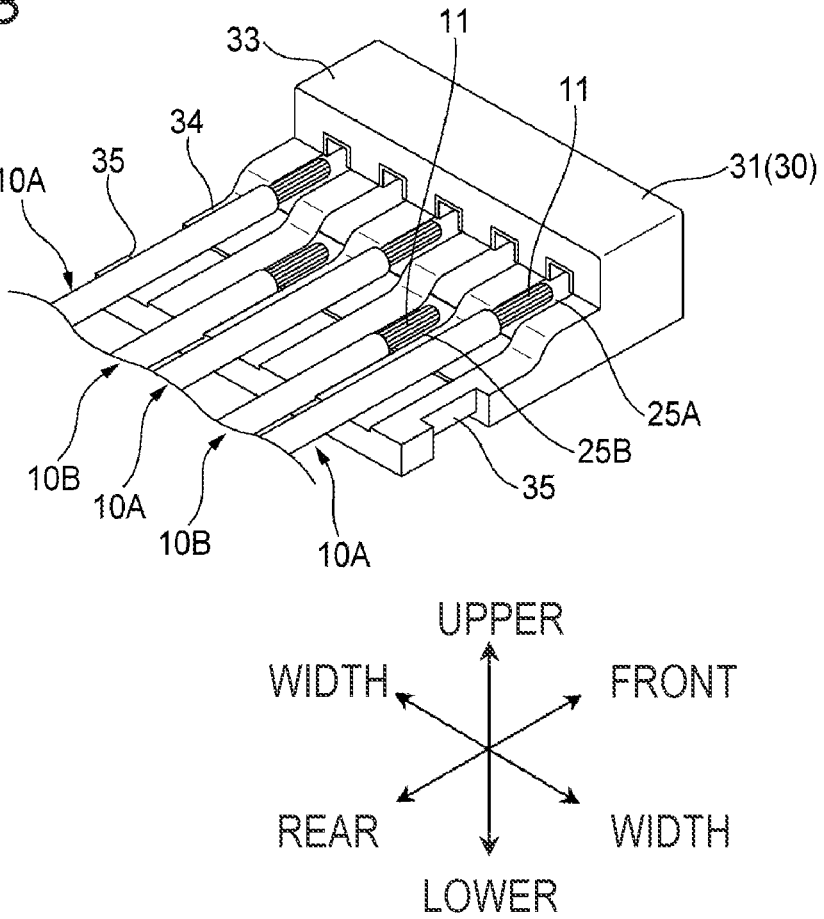
FIG. 4B is a second view for explaining the manufacturing procedure.

Hereinafter, an attaching procedure of the connector 1 will be described. First, as shown in FIG. 4B, the copper electric wire 10A or the aluminum electric wire 10B is joined to each of the plurality of terminals 20 already integrated with the lower housing 31. In the example shown in FIG. 4B, the copper electric wires 10A and the aluminum electric wires OB are alternately arranged along the width direction and joined to the plurality of terminals 20 arranged along the width direction. The conductor core wire 11 of the copper electric wire 10A is selectively joined to the copper connection portion 25A of each terminal 20 to which the copper electric wire 10A is to be connected, and the conductor core wire 11 of the aluminum electric wire 10B is selectively joined to the aluminum connection portion 25B of each terminal 20 to which the aluminum electric wire 10B is to be connected. Here, each of the plurality of terminals 20 and each of the conductor core wires 11 may be joined individually (one by one) or collectively (by one action). At the time of such joining, for example, laser irradiation using the galvano scanner described above or the like can be used.

In this way, by joining the plurality of electric wires 10 to the plurality of terminals 20, as shown in FIG. 4B, the plurality of electric wires 10 extend rearward from a rear end edge of the lower housing 31 in a state where the electric wires 10 are arranged at intervals with each other in a row in the width direction.

Next, as shown in FIG. 5A, the upper housing 32 is attached to the lower housing 31 in such a manner that the connection portion holding portion 34 of the lower housing 31 is covered from above, the plurality of electric wires 10 are each accommodated in the corresponding electric wire holding portion 36, and the pair of engaging protrusions 37 of the upper housing 32 are engaged with the pair of engaging recesses 35 of the lower housing 31. As a result, attaching of the connector 1 is completed, and the connector 1 shown in FIG. 5B is obtained.

In a completely attached state of the connector 1, a state where the upper housing 32 and the lower housing 31 are attached to each other can be maintained due to engagement between the pair of engaging protrusions 37 and the pair of engaging recesses 35. Further, since the plurality of electric wires 10 are located between the plurality of electric wire holding portions 36 and the plurality of terminals 20 and are maintained in a state of being accommodated in the plurality of electric wire holding portions 36, displacement of each electric wire 10 relative to the corresponding terminal 20 can be restrained.

As described above, according to the terminal-equipped electric wire 2 according to the present embodiment, the plurality of types of metal materials (copper material and aluminum material) are integrated by cladding in which the metal materials are bonded to each other in a state of being in contact with each other in a pressed manner, and the terminal 20 is formed of such a composite metal material. The terminal 20 includes the plurality of connection portions 25 (the copper connection portion 25A and the aluminum connection portion 25B), each of which is formed of the metal material of each of the plurality of types of metal materials. Among the plurality of connection portions 25, the conductor core wire 11 of the electric wire 10A (or the electric wire 10B) is joined to the copper connection portion 25A (or to the aluminum connection portion 25B) formed of a metal material corresponding to the copper material (or the aluminum material), which is a metal material forming the conductor core wire 11 of the electric wire 10A (or the electric wire 10B). As a result, the terminal-equipped electric wire 2 can be manufactured by using the common terminal 20 regardless of the type of the electric wire 10 (the electric wire 10A or the electric wire 10B). Therefore, the terminal-equipped electric wire 2 according to the present embodiment is excellent in manufacturing efficiency.

Further, according to the terminal-equipped electric wire 2 according to the present embodiment, the copper connection portion 25A and the aluminum connection portion 25B are disposed at the offset positions, and thus the conductor core wire 11 joined to the copper connection portion 25A (or to the aluminum connection portion 25B) is isolated from the aluminum connection portion 25B (or from the copper connection portion 25A). As a result, even when the terminal-equipped electric wire 2 is exposed to water or the like, occurrence of galvanic corrosion between the conductor core wire 11 and another connection portion can be prevented.

Further, according to the terminal-equipped electric wire 2 according to the present embodiment, when the copper electric wire 10A is used, the copper electric wire 10A may be joined to the copper connection portion 25A of the terminal 20, and when the aluminum electric wire 10B is used, the aluminum electric wire 10B may be joined to the aluminum connection portion 25B of the terminal 20. That is, the terminal-equipped electric wire 2 can be manufactured by using the common terminal 20 for both the copper electric wire 10A and the aluminum electric wire 10B that are generally used in a wire harness or the like of an automobile.

Further, according to the connector 1 according to the present embodiment, since the terminal 20 can be common regardless of the type of the electric wire 10, the connector 1 can be manufactured by accommodating the terminal 20 in the housing 30 in advance (specifically, by insert molding) and then joining the conductor core wire 11 of the electric wire 10 to the connection portion 25 according to the type of the electric wire 10. As a result, the housing 30 and the terminal 20 can be common regardless of the type of the electric wire 10 during manufacturing of the connector 1.

Further, according to the connector 1 according to the present embodiment, displacement of the electric wire 10 connected to the terminal 20 held by a terminal holding portion (the contact portion holding portion 33 and the connection portion holding portion 34) of the connector 1 relative to the terminal 20 is restrained by a displacement restraining portion (the electric wire holding portion 36). As a result, it is possible to prevent a load from being applied to a joint portion between the connection portion of the terminal 20 and the conductor core wire 11 of the electric wire 10 due to a positional deviation of the electric wire 10 caused by an external force or the like applied to the electric wire 10. Therefore, reliability of electric connection between the terminal 20 and the electric wire 10 can be improved.

Further, according to the manufacturing method of the connector 1 according to the present embodiment, the terminal 20 that has a common structure regardless of the type of the electric wire 10 is held in the housing 30 in advance (specifically, by insert molding), then the conductor core wire 11 of the electric wire 10 is joined to the connection portion 25 according to the type of the electric wire 10 so as to manufacture the connector. As a result, the housing 30 and the terminal 20 can be common regardless of the type of the electric wire 10 during manufacturing of the connector 1.

Further, according to the manufacturing method of the connector 1 according to the present embodiment, the displacement of the electric wire 10 connected to the terminal 20 held by the terminal holding portion (the contact portion holding portion 33 and the connection portion holding portion 34) of the connector 1 relative to the terminal 20 is restrained by the displacement restraining portion (the electric wire holding portion 36). As a result, it is possible to prevent a load from being applied to a joint portion between the connection portion 25 of the terminal 20 and the conductor core wire 11 of the electric wire 10 due to a positional deviation of the electric wire 10 caused by an external force or the like applied to the electric wire 10. Therefore, the reliability of the electric connection between the terminal 20 and the electric wire 10 can be improved.

While the presently disclosed subject matter has been described with reference to certain exemplary embodiments thereof, the scope of the presently disclosed subject matter is not limited to the exemplary embodiments described above, and it will be understood by those skilled in the art that various changes and modifications may be made therein without departing from the scope of the presently disclosed subject matter as defined by the appended claims.

Figure 6A:
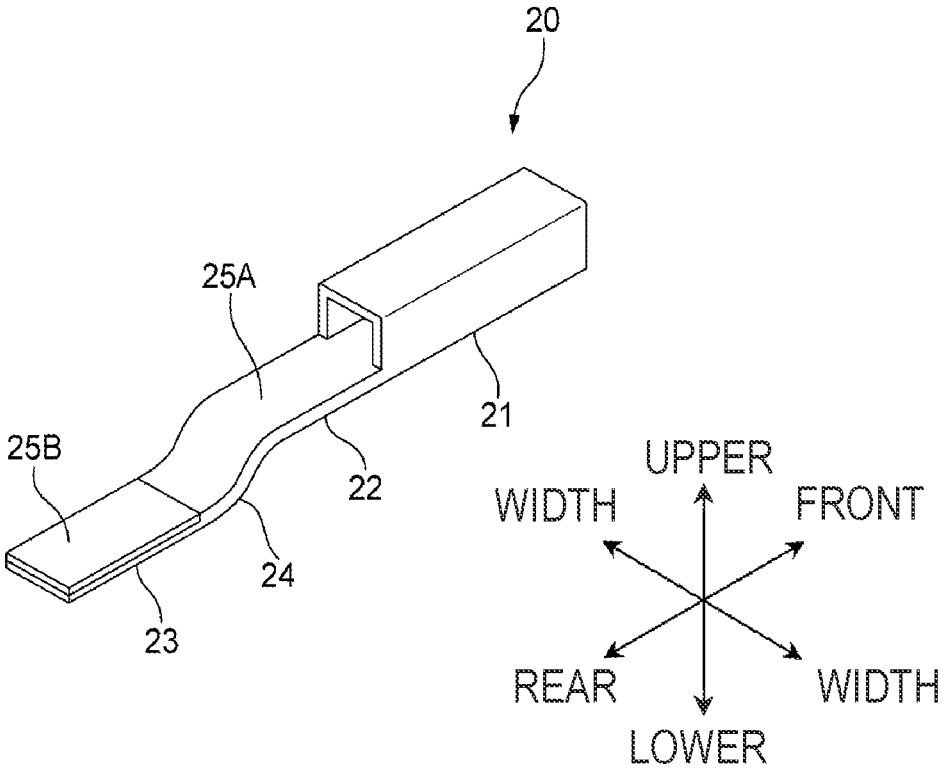
FIGS. 6A and 6B show a terminal according to a modification.
Figure 6B:
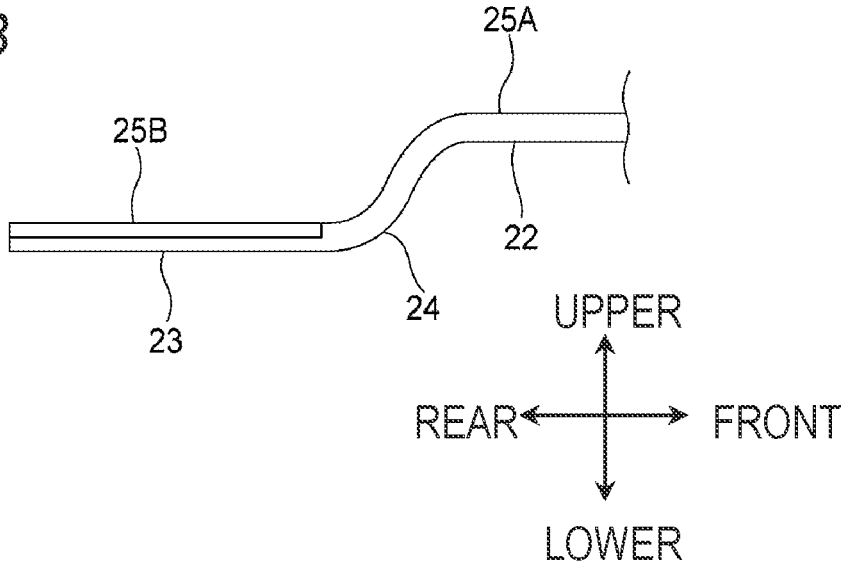

In the above embodiment, in the terminal 20, the respective portions forming the boundary positions 24*a* of "the first connection portion 22, and the part of the step portion 24 above the boundary position 24*a*" (which is the copper material portion) and "the second connection portion 23 and the another part of the step portion 24 below the boundary position 24*a*" (which is the aluminum material portion) are integrally connected by cladding so as to be arranged side by side with each other along the front-rear direction, thereby integrating the copper material portion and the aluminum material portion (see FIGS. 1 and 3B). That is, the terminal 20 is formed by using the so-called "parallel clad material". On the other hand, as shown in FIGS. 6A and 6B, the second connection portion 23 of the terminal 20 may also be formed of two layers, and a lower layer portion of the second connection portion 23 out of "the first connection portion 22, the step portion 24, and the lower layer portion of the second connection portion 23" (which is the copper material portion) and "an upper layer portion of the second connection portion 23" (which is the aluminum material portion) may be integrated by cladding in a state of being laminated with each other along the upper-lower direction so as to integrate the copper material portion and the aluminum material portion. That is, the terminal 20 may also be formed by using a so-called "laminated clad material".

In the example shown in FIGS. 6A and 6B, similarly to the above embodiment, the upper surface of the first connection portion 22 (that is, the upper surface of the copper material portion) forms the copper connection portion 25A, and the upper surface of the second connection portion 23 (that is, the upper surface of the aluminum material portion) forms the aluminum connection portion 25B. The aluminum connection portion 25B is disposed at a position that is located on the rear side and offset downward relative to the copper connection portion 25A. Therefore, as in the above-described embodiment, even when the terminal-equipped electric wire 2 is exposed to water or the like, occurrence of galvanic corrosion between the conductor core wire 11 and the connection portion 25 that is not joined to the conductor core wire 11 among the copper connection portion 25A and the aluminum connection portion 25B can be prevented.

Figure 7:
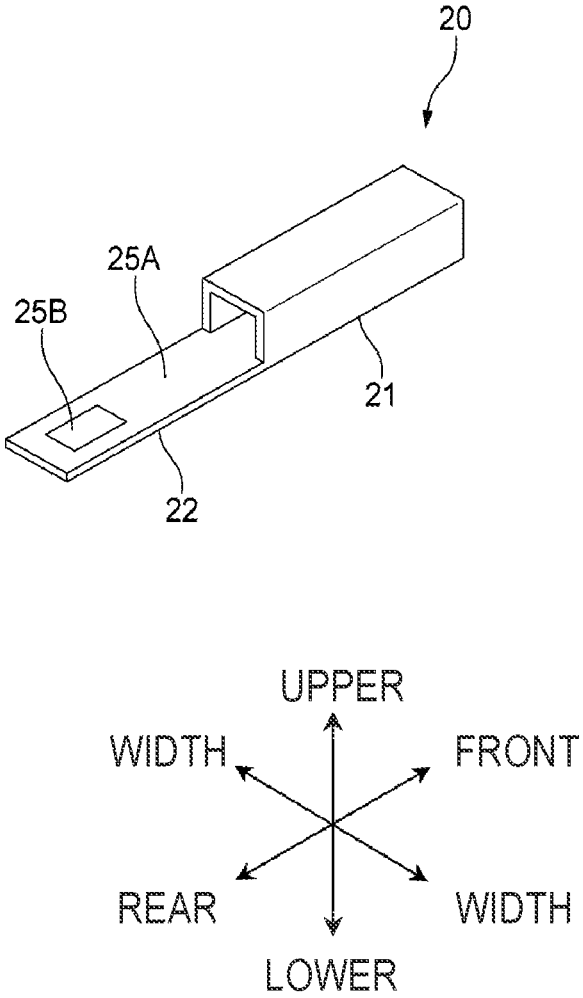
FIG. 7 is a perspective view of a terminal according to another modification.

Further, as shown in FIG. 7, in the terminal 20, the second connection portion 23 and the step portion 24 may be omitted. Only a central portion surrounded by a peripheral edge portion of a tip end portion of the rectangular flat plate-shaped first connection portion 22 may be formed of two layers, in which a lower layer portion of the central portion out of "a portion of the first connection portion 22 other than the central portion of the first connection portion 22 and the lower layer portion of the central portion" (which is the copper material portion) and an "upper layer portion of the central portion" (which is the aluminum material portion) may be integrated by cladding in a state of being laminated with each other along the upper-lower direction so as to integrate the copper material portion and the aluminum material portion. In this case, an upper surface of the portion other than the central portion of the first connection portion 22 (that is, the upper surface of the copper material portion) forms the copper connection portion 25A, and an upper surface of the central portion of the first connection portion 22 (that is, the upper surface of the aluminum material portion) forms the aluminum connection portion 25B. In the example shown in FIG. 7, the aluminum connection portion 25B is disposed at the same position as the copper connection portion 25A in the upper-lower direction, while being located on the rear side relative to the copper connection portion 25A.

Further, in the above embodiment, two types of metal materials, namely the copper material and the aluminum material, are adopted as the plurality of types of metal materials forming the terminal 20. However, as the plurality of types of metal materials, a combination of two types of metal materials other than the copper material and the aluminum material may be adopted, or three or more types of metal materials may be adopted.

According to an aspect of the embodiments described above, a terminal-equipped electric wire (2) includes an electric wire (10A, 10B) including a conductor core wire (11) formed of a conductor material and a terminal (20) formed of a composite metal material in which a plurality of types of metal materials are clad-bonded with each other. The terminal (20) includes a first connection portion (25A) and a second connection portion (25B), each of which is formed of a metal material of respective one of the plurality of types of metal materials. The conductor core wire (11) is electrically connected to one of the first and second connection portions (25A, 25B), the one corresponding to the conductor material forming the conductor core wire (11).

According to the terminal-equipped electric wire having the above configuration, the terminal is formed of the composite metal material integrated by cladding in which the plurality of types of metal materials are bonded to each other in a state of being in contact with each other in a pressed manner. The terminal includes the plurality of connection portions, each of which is formed of a metal material of each of the plurality of types of metal materials. The conductor core wire of the electric wire is electrically connected to the connection portion formed of the metal material corresponding to the conductor material forming the conductor core wire of the electric wire among the plurality of connection portions. Here, the metal material "corresponding" to the conductor material forming the conductor core wire means that the conductor material of the conductor core wire and the metal material forming the connection portion are the same, or the conductor material of the conductor core wire and the metal material are not completely the same but a natural potential difference therebetween is small to such an extent that there is no concern about quality deterioration caused by galvanic corrosion. As a result, the terminal-equipped electric wire can be manufactured by using a common terminal regardless of the type of the conductor material forming the conductor core wire of the electric wire (hereinafter, also simply referred to as "type of electric wire"). Therefore, the terminal-equipped electric wire having the present configuration is superior in production efficiency as compared with a terminal-equipped electric wire in related art. For example, the terminal-equipped electric wire having the present configuration is suitable for manufacturing by an automatic machine.

Cladding is a technique in which bonding surfaces of the metal materials are brought into contact with each other in a pressed manner and subjected to a pressure treatment and a heat treatment to promote mutual diffusion of metal atoms forming both of the metal materials, thereby firmly diffusion-bonding both of the bonding surfaces to each other. Unlike techniques such as plating, generally no fragile intermetallic compound is generated between the bonding surfaces bonded by cladding. In this respect, cladding is excellent in bonding strength as compared with techniques such as plating, and separation between bonding surfaces or the like is less likely to occur.

Further, the method for electrically connecting the conductor core wire of the electric wire to the connection portion is not particularly limited, and for example, methods such as welding using a laser, pressure joining, or ultrasonic joining can be used.

The first connection portion (25A) and the second connection portion (25B) may be arranged at positions offset from each other.

With this configuration, the conductor core wire connected to the one connection portion is isolated from the other connection portion by arranging the one connection portion and the other connection portion at the offset positions (deviated from each other). As a result, even when the terminal-equipped electric wire is exposed to water or the like, occurrence of galvanic corrosion between the conductor core wire and the other connection portion can be prevented.

The plurality of types of metal materials may include copper, a copper alloy, aluminum and an aluminum alloy. The terminal may further include a contact portion (21) configured to be electrically connected to a mating terminal. The first connection portion (25A) may be connected to the contact portion (21). The second connection portion (25B) may be clad-bonded to the first connection portion (25A). The contact portion (21) and the first connection portion (25A) may be formed of copper or a copper alloy and the second connection portion (25B) may be formed of aluminum or an aluminum alloy.

With this configuration, in a case where a copper electric wire whose conductor core wire is made of copper or a copper alloy is used, the conductor core wire may be joined to one contact portion made of copper or a copper alloy, and in a case where an aluminum electric wire whose conductor core wire is made of aluminum or an aluminum alloy is used, the conductor core wire may be joined to another contact portion made of aluminum or an aluminum alloy. That is, the terminal-equipped electric wire can be manufactured by using a common terminal for both the copper electric wire and the aluminum electric wire that are generally used in a wire harness or the like of an automobile.

A connector (1) may include the terminal-equipped electric wire (2) and a housing (30) configured to accommodate the terminal-equipped electric wire (2).

According to the connector having the above configuration, the terminal can be common regardless of the type of the electric wire. Therefore, for example, the connector can be manufactured by putting the terminal in the housing in advance (for example, by insert molding) and then connecting the conductor core wire of the electric wire to the connection portion corresponding to the type of the electric wire. As a result, the housing and the terminal can be common regardless of the type of the electric wire during manufacturing of the connector, and thus production efficiency of the connector can be improved.

The housing (30) may include a terminal holding portion (33, 34) configured to hold the terminal (20) and a displacement restraining portion (36) configured to restrain displacement of the electric wire (10A, 10B) relative to the terminal (20).

With this configuration, the displacement of the electric wire connected to the terminal held by the terminal holding portion of the connector relative to the terminal is restrained by the displacement restraining portion. As a result, when the connector is actually used, it is possible to prevent a load from being applied to a joint portion between the connection portion and the conductor core wire due to a positional deviation of the electric wire caused by an external force or the like applied to the electric wire. Therefore, reliability of electric connection between the terminal and the electric wire can be improved.

A manufacturing method for manufacturing the connector (1) including the terminal-equipped electric wire (2) and a housing (30) configured to accommodate the terminal-equipped electric wire (2) may include holding the terminal (20) in the housing (30) such that at least a part of each of the first and second connection portions (25A. 25B) is exposed, selecting one connection portion out of the first and second connection portions (25A, 25B) which corresponds to the conductor material forming the conductor core wire (11) of the electric wire (10A, 10B) to be used and electrically connecting the conductor core wire (11) of the electric wire (10A, 10B) to be used to the one connection portion.

According to the manufacturing method of the connector having the above configuration, the terminal having a common structure regardless of the type of the electric wire is held in the housing in advance (for example, by insert molding), then the connection portion according to the type of the electric wire is selected and the conductor core wire of the electric wire is joined thereto so as to manufacture the connector. As a result, the housing and the terminal can be common regardless of the type of the electric wire during manufacturing of the connector, and thus the connector can be efficiently manufactured.

The housing (30) may include a first component (31) including a terminal holding portion (33, 34) configured to hold the terminal (20) and a second component (32) including a displacement restraining portion (36) configured to restrain displacement of the electric wire (10A, 10B) connected to the terminal (20) relative to the terminal (20). The manufacturing method may further include attaching the first component (31) and the second component (32) to each other.

With this configuration, the displacement of the electric wire connected to the terminal held by the terminal holding portion of the connector relative to the terminal is restrained by the displacement restraining portion. As a result, when the manufactured connector is actually used, it is possible to prevent a load from being applied to a joint portion between the connection portion and the conductor core wire due to a positional deviation of the electric wire caused by an external force or the like applied to the electric wire. Therefore, the reliability of the electric connection between the terminal and the electric wire can be improved.

What is claimed is:

1. A terminal-equipped electric wire comprising:

an electric wire including: a conductor core wire formed of a conductor material; and a terminal formed of a composite metal material in which a plurality of types of metal materials are clad-bonded with each other, wherein the terminal includes a first connection portion and a second connection portion, each of which is formed of a metal material of a respective one of the plurality of types of metal materials, wherein the conductor core wire is electrically connected to and mounted onto the first connection portion when the conductor material of the conductor core wire corresponds to the metal material of the first connection portion, and the conductor core wire is electrically connected to and mounted onto the second connection portion when the conductor material of the conductor core wire corresponds to the metal material of the second connection portion.

2. The terminal-equipped electric wire according to claim 1, wherein the first connection portion and the second connection portion are arranged at positions offset from each other.

3. The terminal-equipped electric wire according to claim 1, wherein the plurality of types of metal materials include copper, a copper alloy, aluminum and an aluminum alloy;

wherein the terminal further includes a contact portion configured to be electrically connected to a mating terminal;

wherein the first connection portion is connected to the contact portion;

wherein the second connection portion is clad-bonded to the first connection portion; and wherein the contact portion and the first connection portion are formed of copper or a copper alloy and the second connection portion is formed of aluminum or an aluminum alloy.

4. A connector including:

the terminal-equipped electric wire according to claim 1; and a housing configured to accommodate the terminal-equipped electric wire.

5. The connector according to claim 4, wherein the housing includes: a terminal holding portion configured to hold the terminal; and a displacement restraining portion configured to restrain displacement of the electric wire relative to the terminal.

6. A manufacturing method for manufacturing the connector including the terminal-equipped electric wire according to claim 1 and a housing configured to accommodate the terminal-equipped electric wire, the manufacturing method including:

holding the terminal in the housing such that at least a part of each of the first and second connection portions is exposed;

selecting one connection portion out of the first and second connection portions which corresponds to the conductor material forming the conductor core wire of the electric wire to be used; and electrically connecting the conductor core wire of the electric wire to be used to the one connection portion.

7. The manufacturing method according to claim 6, wherein the housing includes: a first component including a terminal holding portion configured to hold the terminal; and a second component including a displacement restraining portion configured to restrain displacement of the electric wire connected to the terminal relative to the terminal; and wherein the manufacturing method further includes: attaching the first component and the second component to each other.

* * * * *